US006529129B1

(12) United States Patent
Tomooka

(10) Patent No.: US 6,529,129 B1
(45) Date of Patent: Mar. 4, 2003

(54) SECURITY SENSOR HAVING DISTURBANCE DETECTING CAPABILITY

(75) Inventor: Hiroyuki Tomooka, Otsu (JP)

(73) Assignee: Optex Co., Ltd., Shiga (JP)

( * ) Notice: Subject to any disclaimer, the term of this patent is extended or adjusted under 35 U.S.C. 154(b) by 0 days.

(21) Appl. No.: 09/781,022

(22) Filed: Feb. 9, 2001

(30) Foreign Application Priority Data

Feb. 18, 2000 (JP) ..... 2000-040702

(51) Int. Cl.[7] ..... G08B 13/18

(52) U.S. Cl. ..... 340/556; 340/555; 340/552; 340/565; 340/567; 340/545.3; 250/342; 250/341

(58) Field of Search ..... 340/556, 555, 340/552, 551, 541, 545.3, 561, 565, 567; 250/342, 341, 341.8

(56) References Cited

U.S. PATENT DOCUMENTS

| | | | | | |
|---|---|---|---|---|---|
| 4,982,094 | A | * | 1/1991 | Matsuda | 340/567 |
| 5,243,326 | A | * | 9/1993 | Disabato | 340/555 |
| 5,489,892 | A | * | 2/1996 | Imuro et al. | 340/567 |
| 5,831,529 | A | * | 11/1998 | Pantus | 340/555 |
| 5,942,976 | A | * | 8/1999 | Wieser et al. | 340/505 |

FOREIGN PATENT DOCUMENTS

| | | | |
|---|---|---|---|
| EP | 0817148 | | 1/1998 |
| JP | 2287278 | | 11/1990 |
| JP | 11096467 | A * | 9/1997 |
| JP | 11250362 | A * | 2/1998 |
| JP | 410334353 | A * | 12/1998 |
| JP | 11086152 | A * | 3/1999 |

* cited by examiner

*Primary Examiner*—Daniel J. Wu
*Assistant Examiner*—Daniel Previl

(57) ABSTRACT

A security sensor 1 having a disturbance detecting capability capable of detecting the presence of an obstacle purposefully applied to the sensor 1 in an attempt to fool or tamper the sensor 1 includes a carrier body A having an infrared sensor element 4, an incident side enclosure 5 mounted on the carrier body A, a light projecting element 11 for projecting a disturbance detecting beam L1, a light receiving element 12 for receiving disturbance detecting beam L1, first and second light guide members 8, 9 operatively associated with the light projecting element 11 and the light receiving element 12, respectively, said first and second light guide members 8, 9 being cooperative with each other to define an optical path L along and adjacent an outer surface of the incident side enclosure 5 or an outer surface of the carrier body A adjacent the incident side enclosure 5, a detecting circuit 15 for detecting a presence or absence of an obstacle, applied to at least one of the first and second light guide members 8, 9, based on an amount of light received by the light receiving element 12. Surface irregularities are formed on a light transmitting surface 8*c* or 9*c*, or a light reflecting surface 8*b* or 9*b* of the light guide members 8 and 9.

19 Claims, 6 Drawing Sheets

SECURITY SENSOR HAVING DISTURBANCE DETECTING CAPABILITY

BACKGROUND OF THE INVENTION 1. (Field of the Invention)

The present invention generally relates to a security sensor of a type utilizing a passive-type infrared sensor element and, more particularly, to the security sensor of a type having a disturbance detecting capability for detecting the presence or absence of an obstacle such as, for example, a transparent paint applied to the sensor casing to disable the security sensor.

2. (Description of the Prior Art)

An intruder detecting system utilizing the security sensor of the type referred to above is so designed and so configured as to detect an intruder within a detection area or an area of surveillance in reference to the difference between the temperature of a human body and the ambient temperature when the passive-type infrared sensor element receives far infrared rays of light emitted from the human body within the detection area.

It has often been experienced that the intruder detecting system is tampered with an obstacle such as, for example, a transparent paint of a kind capable of transmitting therethrough rays of light ranging from a visible wavelength region to a near infrared wavelength region, but intercepting far infrared rays of light, so that the intruder detecting system may be fooled enough to allow an intruder to trespass on the detection area monitored by the passive-type infrared sensor element. For example, while the intruder detecting system is held inoperative because the detection area is crowded with people moving in and out of the detection area, a potential intruder may enter the detection area and then apply or otherwise spray the transparent paint of the kind referred to above to a light receiving enclosure or an incident side enclosure such as, for example, a sensor lens or cover through which the far infrared rays of light enter, so that the potential intruder can enter again the detection area later while the intruder detecting system is switched in operation with the detection area no longer crowded with people.

In view of the above, the security sensor equipped with a disturbance detector for detecting the presence or absence of the obstacle has been well known in the art and is disclosed in, for example, the Japanese Laid-open Patent Publication No. 2-287278. According to this publication, the disturbance detector used in the security sensor includes a light projecting element and a light receiving element and is so configured that while an obstacle detecting light of a wavelength ranging from a near infrared wavelength region to a visible wavelength region is emitted from the light projecting element so as to travel towards an inner surface of a lens, which forms a part of the light receiving enclosure of the security sensor and through which far infrared rays of light emitted from a human body pass onto a far infrared sensor element, the light receiving element may receive the obstacle detecting light reflected from the inner surface of the lens. In this structure, in the event that the obstacle is applied to an outer surface of the lens, the obstacle detecting light reflected form the inner surface of the lens and traveling towards the light receiving element apparently contains a component of light reflected from the obstacle and, therefore, the amount of light incident on the light receiving element is higher when the obstacle is applied to the outer surface of the lens than that when no obstacle is applied thereto. By detecting an increase in amount of the light incident on the light receiving element relative to the standard amount of light normally received by the same light receiving element, the disturbance detector can detect the presence of the obstacle on the outer surface of the lens.

It has, however, been found that with the disturbance detector used in the prior art security sensor, detection of the increment of the light reflected from the obstacle is difficult to achieve where the amount of the obstacle detecting light reflected from the obstacle is insufficiently small relative to the standard amount of the light incident on the light receiving element because the obstacle detecting light reflected from the inner surface of the lens may travel astray.

In particular, in the event that the paint of a kind capable of intercepting passage of far infrared rays of light therethrough is applied or sprayed to a front surface of the lens, the amount of light reflected from the paint decreases so extremely that the disturbance detector may fail to detect it. Moreover, since the transparent paint when applied to the front surface of the lens is virtually discernable with eyes, the presence or absence of the obstacle on the lens is not easy to detect with eyes.

In order to detect the presence of the obstacle such as the transparent paint of the kind discussed above, attempts have hitherto been made to capture an instantaneous change of the amount of the obstacle detecting light when the obstacle is applied (i.e., to detect the act of applying the obstacle) or to employ an increased emitting and receiving power of the disturbance detector. However, the former does not only require the disturbance detector to be activated at all times, but also is susceptible to an erroneous detection resulting from an erroneous operation of the disturbance detector. On the other hand, the latter may often result in an erroneous detection even when small insects traverse.

SUMMARY OF THE INVENTION

Accordingly, the present invention has been devised to substantially alleviate the foregoing problems inherent in the prior art security sensors and is intended to provide an improved security sensor having a disturbance detecting capability capable of easily detecting the presence of an obstacle such as, for example, a transparent paint of the kind referred to above when the latter is applied to a front surface of the light receiving enclosure of the security sensor.

In order to accomplish the foregoing object of the present invention, there is provided a security sensor having a disturbance detecting capability, which includes a carrier body having an infrared sensor element; an incident side enclosure or an light receiving enclosure mounted on the carrier body, said incident side enclosure comprising a lens that defines at least one detection area for the infrared sensor element or a cover that covers an incident surface area of the infrared sensor element; a light projecting element for projecting a disturbance detecting beam; a light receiving element for receiving at least a portion of the disturbance detecting beam; first and second light guide members operatively associated with the light projecting element and the light receiving element, respectively, and being cooperative with each other to define an optical path and adjacent an outer surface of the incident side enclosure or an outer surface of the carrier body adjacent the incident side enclosure so as to extend between the first and second light guide members; a detecting circuit for detecting a presence or absence of an obstacle, applied to at least one of the first and second light guide members, based on an amount of light received by the light receiving element; and surface irregularities formed on a light transmitting surface or a light reflecting surface of the first or second light guide member which surface is exposed outwardly at the optical path.

According to the present invention, when the transparent paint is applied to the outer surface of the incident side enclosure and the applied transparent paint deposits in at least some of the surface irregularities, such irregularities are filled up to define a substantially flat surface and, therefore, the amount of light incident on the light receiving element increases. Also, in the event that a black-colored paint is applied to the outer surface of the incident side enclosure and the applied black-colored paint deposits on the light transmitting or reflective surfaces of the first or second light guide member, the amount of light incident on the light receiving element decreases. Accordingly, the presence of the obstacle such as the transparent paint or the black-colored paint intercepting the far infrared light, but transmitting the disturbance detecting light can be assuredly detected. Also, even though a small obstacle such as a fly or an insect perches temporarily on the outer surface of the incident side enclosure, and since the amount of the light reflected from such small obstacle is small, there is no possibility of the security sensor functioning erroneously.

In a preferred embodiment of the present invention, the first light guide member has a first light incident surface, a first light exit surface and a first light reflecting surface defined therein and is operable to guide the beam from the first light incident surface towards the first light exit surface through the first light reflecting surface, and the second light guide ember has a second light incident surface, a second light exit surface and a second light reflecting surface defined therein and is operable to guide the beam from the second light incident surface towards the second light exit surface through the second light reflecting surface. The surface irregularities are preferably formed on at least one of the first light exit surface, the first light reflecting surface, the second light incident surface and the second light reflecting surface.

Also, in a preferred embodiment of the present invention, the first and second light guide members are mounted on the carrier body at respective locations outside an area of incidence of infrared light on the infrared sensor element. This is particularly advantageous in that the use of the first and second light guide members will not lower the detecting capability of the security sensor.

Preferably the infrared sensor element, the light projecting element and the light receiving element may be mounted on a common circuit board. This is particularly advantageous in that since only one circuit board is sufficient, the structure of the security sensor can be simplified.

Also preferably, the carrier body comprises a support base for supporting the infrared sensor element, the light projecting element and the light receiving element, a casing and a lens which defines the incident side enclosure and fitted to the casing with the infrared sensor element, the light projecting element and the light receiving element being covered by the casing and the lens. The first and second light guide members may then be positioned on the casing at respective locations adjacent the lens. This arrangement is directed to the security sensor of a type wherein the lens exposed to the outside is used to cover frontward of the detecting elements.

Again, the carrier body may comprise a support base for supporting the infrared sensor element, the light projecting element and the light receiving element, and a cover which defines the incident side enclosure and fitted to the support base so as to enclose the infrared sensor element, the light projecting element and the light receiving element, and wherein the first and second light guide members are positioned on the cover at respective locations spaced a distance from each other. This arrangement is directed to the security sensor of a type wherein the cover is used to enclose the circuit boards including the infrared sensor element.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of the present invention will be described with reference to the accompanying drawings.

Figure 1:
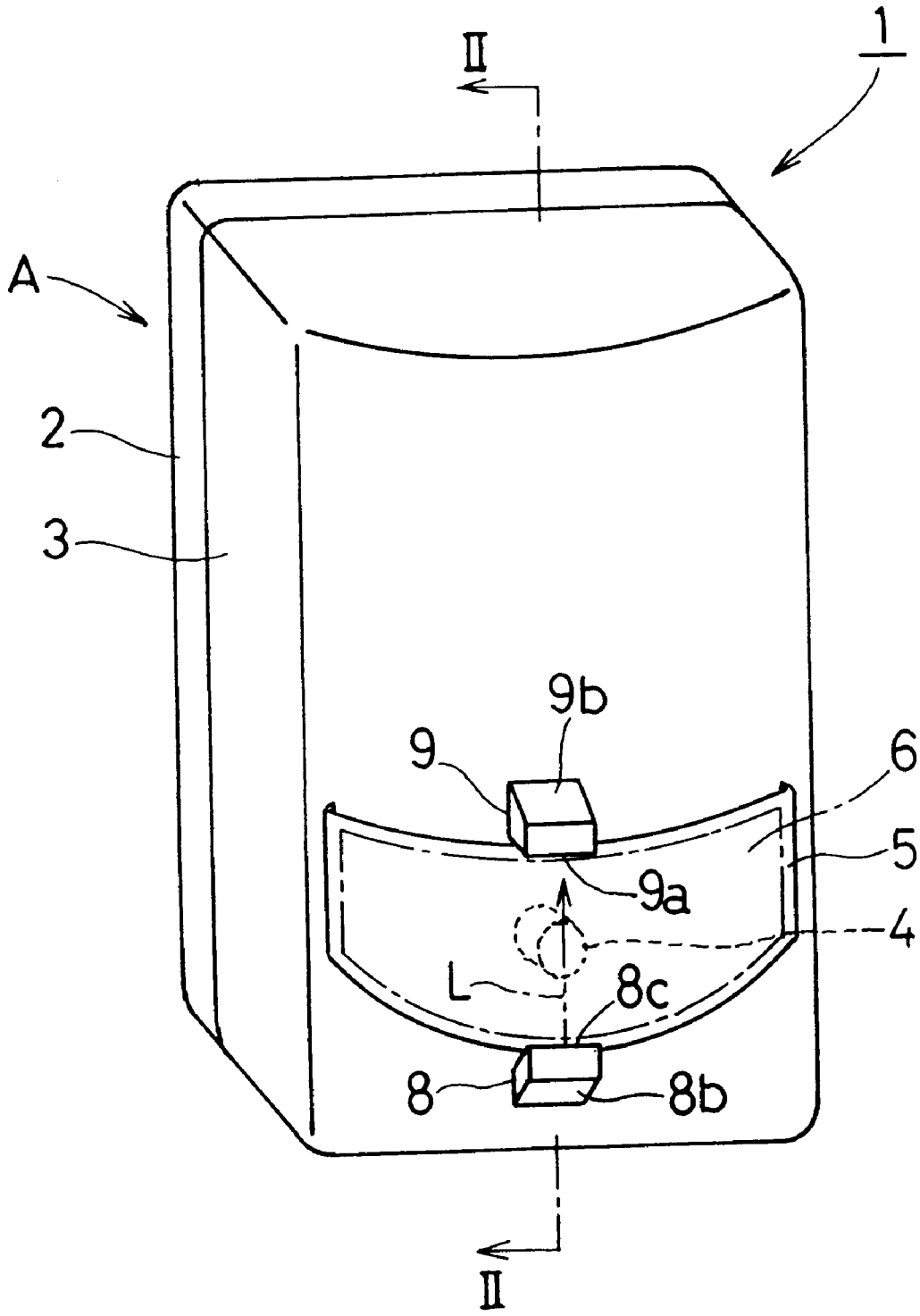
FIG. 1 is a perspective view of a security sensor having a disturbance detecting capability according to a first preferred embodiment of the present invention.

FIG. 1 illustrates a perspective view of a security sensor according to a first preferred embodiment of the present invention. This security sensor 1 includes a generally rectangular box-like carrier body A made up of a generally rectangular base 2 adapted to be fitted to a support surface such as, for example, a ceiling or a wall, and a cap-like cover casing 3 fitted to the base 2 for covering a front surface region of the base 2, and a pyroelectric element 4 which is a passive-type far infrared sensing element and which is accommodated within the carrier body A. The casing 3 is detachably secured to the base 2 by means of a plurality of fitting screws (not shown).

Figure 2:
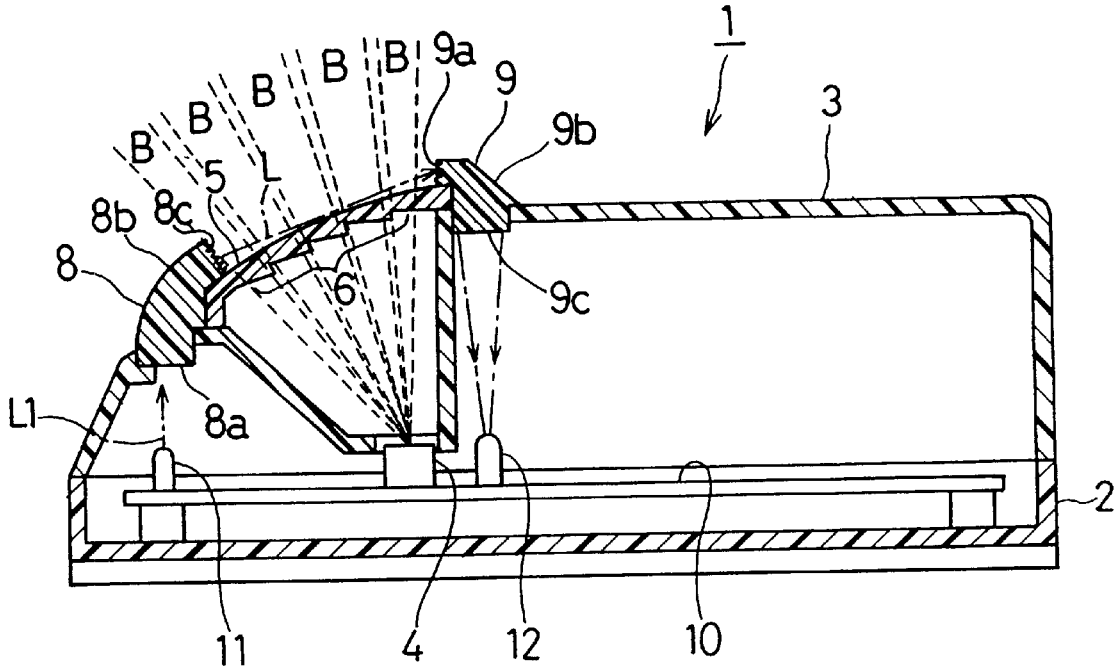
FIG. 2 is a cross-sectional view taken along the line II—II in FIG. 1.

As shown in FIG. 2, the casing 3 made up of top and bottom walls, side walls and a front wall has a generally rectangular opening in which a lens 5 serving as an incident side enclosure is fitted. This lens 5 concurrently serves as a protective covering for protecting the pyroelectric element 4 and is made of a synthetic resin such as, for example, polyethylene of a kind capable of transmitting far infrared rays of light therethrough. The lens 5 has an inner surface formed with a Fresnel lens section 6, which section 6 defines a plurality of detection areas B for the pyroelectric element 4. A projector-side guide element or a first light guide element 8 and a receiver-side guide element or a second light guide element 9 are mounted on the front wall of the casing 3 so as to cover lower and upper ends of the lens 5, respectively, and as to be held in face-to-face relation with each other across the lens 5. The light guide elements 8 and 9 are positioned outside the detection areas B, that is, at respective locations outside an area of incidence of far infrared light on the pyroelectric element 4 shown in FIG. 2.

A printed circuit board 10 fitted to the base 2 and positioned within the carrier body A has mounted thereon the pyroelectric element 4, a light projecting element 11 for generating a near infrared light, which is a disturbance detecting light beam L1, so as to be projected towards an incident surface (one of light transmitting surfaces) 8*a* of the projector-side light guide member 8 and a light receiving element 12 for receiving the detecting beam L1, which has emerged outwardly from a light exit surface (one of the light transmitting surfaces) 8*c* of the projector-side light guide member 8 that is exposed to the outside, through the receiver-side light guide member 9. In this way, the pyroelectric element 4, the light projecting element 11 and the light receiving element 12 are supported on and by the base 2 and are covered by the casing 3 and the lens 5 so as to be accommodated within the carrier body A. The projector-side and receiver-side light guide members 8 and 9 are operable to guide the disturbance detecting beam L1 from the light projecting element 11 towards the light receiving element 12 and cooperate with each other to define an optical path L for the disturbance detecting beam L1 that extends along an outer surface of the lens 5. The light exit surface 8*c* of the projector-side light guide member 8 and the light incident surface (one of the light transmitting surfaces) 9*a* of the receiver-side light guide member 9 that is exposed to the outside and confronts with the light exit surface 8*c* are ground, that is, formed with fine surface irregularities generally similar to those found on a ground glass.

The pyroelectric element 4 when detecting through the lens 5 far infrared rays of light emitted from a human body within the detection areas B detects that the human body has intruded the detection areas B. The light projecting element 11 when driven by a drive circuit 13 shown in FIG. 3 emits the disturbance detecting beam L1 towards the light incident surface 8*a* of the projector-side light guide member 8. The disturbance detecting beam L1 entering the projector-side light guide member 8 travels in part towards a light reflecting surface 8*b* of the projector-side light guide member 8, which is exposed to the outside of the projector-side light guide member 8, and in part towards the light exit surface 8*c* thereof without being reflected by the light reflecting surface 8*b*. That portion of the disturbance detecting beam L1 reaching the light reflecting surface 8*c* is in part reflected thereby so as to travel towards the light exit surface 8*c* and in part transmitted through the light reflecting surface 8*b* to the outside of the projector-side light guide element 8. In any event, the light emerging outwardly from the light exit surface 8*c* of the projector-side light guide member 8 is in turn scattered outwardly as shown by the single-dotted chain line and a portion thereof subsequently enters the receiver-side light guide member 9 through the light incident surface 9*a*. The light incident on the light incident surface 9*a* is scattered and a portion thereof is then reflected by a light reflecting surface (a portion of an outer surface) 9*b* of the receiver-side light guide member 9 that is exposed to the outside and is defined by an inclined surface confronting the light incident surface 9*a* of the receiver-side light guide member 9, so that the reflected incident light can be received by the light receiving element 12 through the light exit surface (one of the light transmitting surfaces) 9*c* of the receiver-side light guide member 9. The amount of the light so received by the light receiving element 12 in this way represents a reference incident light amount that is normal in the absence of any obstacle applied to an outer surface of the lens 5. Consequently, an output voltage V from an incident light amount detecting circuit 14 at this time represents a value V0 of a substantially low level as shown in FIG. 4A.

Figure 3:
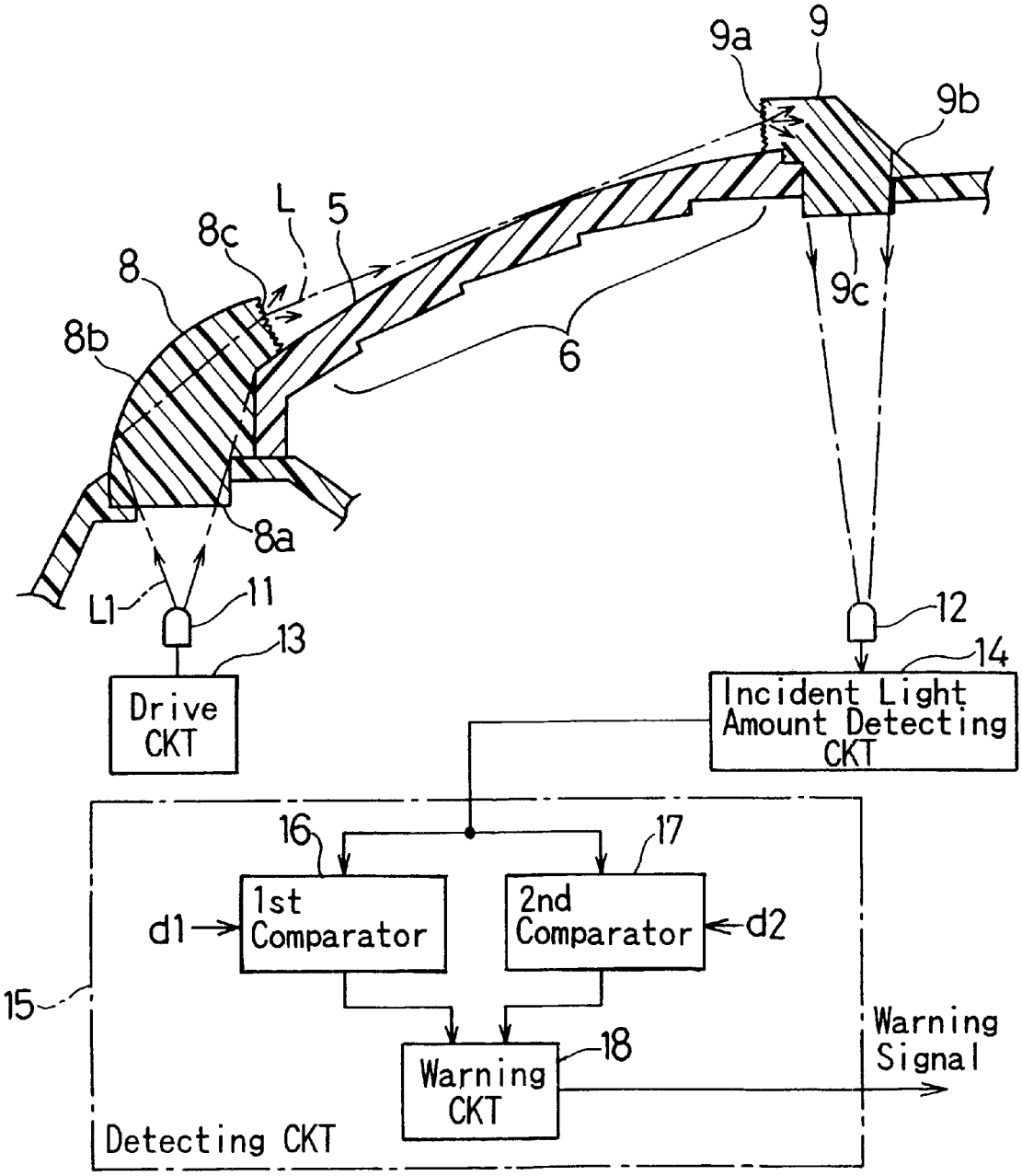
FIG. 3 is a fragmentary sectional view, shown together with a block diagram of a disturbance detecting circuit, showing the manner of propagation of light within first and second light guide members employed in the first preferred embodiment of the present invention.
Figure 4A:
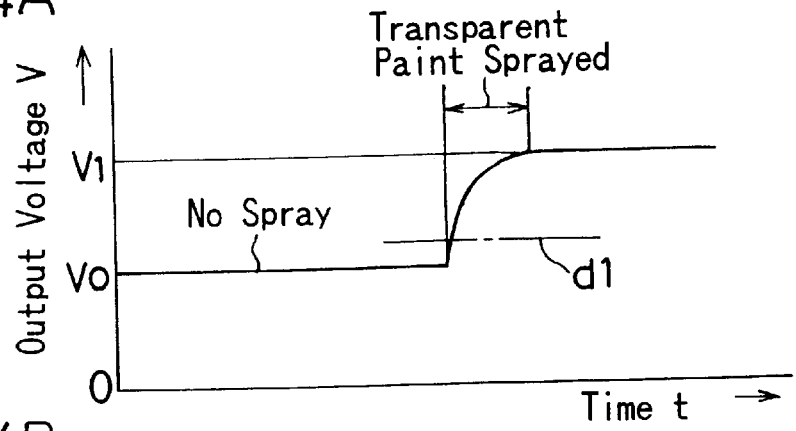
FIG. 4A is a chart showing an output voltage characteristic of an incident light amount detecting circuit used in the first preferred embodiment of the present invention, when a transport obstacle is applied to a lens used in the security sensor.

However, in the event that the obstacle such as, for example, a transparent paint of a kind capable of intercepting far infrared rays of light, but allowing light ranging from a near infrared wavelength region to a visible wavelength region to pass therethrough is applied to the outer surface of the lens 5 shown in FIG. 3, the obstacle so applied deposits on the light exit surface 8*c* of the projector-side light guide member 8 and the light incident surface 9*a* of the receiver-side light guide member 9 to fill up surface irregularities to thereby render the light exit surface 8*c* and the light incident surface 9*a* to be flat. Therefore, scattering of the disturbance detecting beam L1 emerging outwardly from the light exit surface 8*c* of the projector-side light guide member 8 is reduced, resulting in increase of the amount of the disturbance detecting beam L1 incident on the light incident surface 9*a* of the receiver-side light guide member 9, and also the scattering of the light at the light incident surface 9*a* is reduced. Consequently, the amount of the disturbance detecting beam L1 incident on the light receiving element 12 increases whereby the output voltage V from the incident light amount detecting circuit 14 for detecting the amount of the light received by the light receiving element 12 increases to a high level of V1 which is higher than the value V0 as shown in FIG. 4A.

Figure 4B:
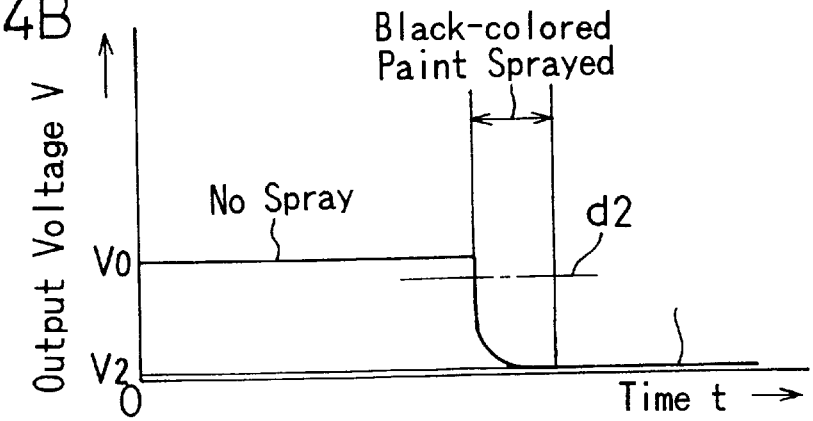
FIG. 4B is a chart showing an output voltage characteristic of an incident light amount detecting circuit used in the first preferred embodiment of the present invention, when a black-colored obstacle is applied to a lens used in the security sensor.

On the other hand, in the event that the obstacle such as, for example, a black-colored paint of a kind capable of intercepting not only far infrared rays of light, but also light ranging from a near infrared wavelength region to a visible wavelength region to pass therethrough is so applied to the outer surface of the lens 5 as to deposit on at least one of the light reflecting surface (a portion of the outer surface) 8*b* and the light exit surface 8*c* of the projector-side light guide member 8, the disturbance detecting beam L1 may be absorbed by such obstacle and, therefore, the amount of the disturbance detecting beam L1 emerging outwardly from the light exit surface 8*c* of the projector-side light guide member 8 decreases. Even when the black-colored paint deposits on at least one of the light incident surface 9*a* and the light reflecting surface 9*b* of the receiver-side light guide member 9, the amount of the light received by the light guide element 12 through the receiver-side light guide member 9 similarly decreases. Consequently, the output voltage V from the incident light amount detecting circuit 14 for detecting the amount of the light received by the light receiving element 12 decreases down to a low level of V2 which is lower than the value V0 as shown in FIG. 4B.

A detecting circuit 15 shown in FIG. 3 includes first and second comparators 16 and 17 and a warning circuit 18. An output voltage V from the incident light amount detecting circuit 14 is supplied to the first and second comparators 16 and 17 so that the output voltage V can be compared by the first comparator 16 with a first threshold value d1 and also by the second comparator 17 with a second threshold value d2. By way of example, the first threshold value d1 for the first comparator 16 is chosen to be a value that is about 1.1 times the low level voltage V0 outputted from the incident light amount detecting circuit 14 when no obstacle is applied, whereas the second threshold value d2 for the second comparator 17 is chosen to be a value that is about 0.9 times the low level voltage V0 when no obstacle is applied.

Depending on the type of the obstacle, for example, the transparent paint or the black-colored paint, applied to the outer surface of the lens 5, the first or second comparator 16 or 17 comparing the input voltage V with the first or second threshold value d1 or d2 outputs a disturbance detection signal to the warning circuit 18 when the voltage V is higher than the first threshold value d1 or lower than the second threshold value d2. The warning circuit 18 then operates in response to the disturbance detection signal from either the first comparator 16 or the second comparator 17 to provide a control room (not shown) with a warning signal. In this way, the presence of the obstacle such as the transparent or black-colored paint applied externally to the outer surface of the lens 5 can be detected.

Also, since the disturbance detecting beam L1 guided through the projector-side light guide member 8 and then through the receiver-side light guide member 9 is received by the light receiving element 12, the respective positions of the light projecting element 11 and the light receiving element 12 can be chosen to be at a position distant from the lens 5 as desired and, therefore, in the illustrated embodiment, the light projecting element 11 and the light receiving elements 12 are positioned on the printed circuit board 10 readily available for the support thereof Also, since the amount of light received by the light receiving element 12 does not substantially change even when a small object such as, for example, an insect temporarily deposits on the outer surface of the lens 5, the security sensor embodying the present invention will not result in an erroneous operation with the small object detected as an obstacle.

Figure 5:
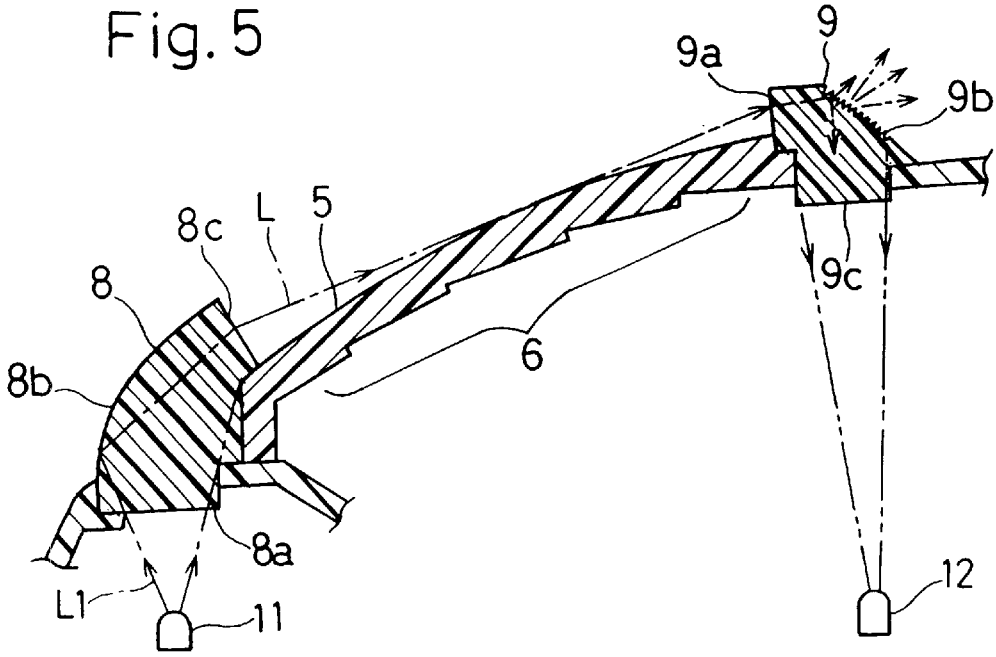
FIG. 5 is a fragmentary sectional view, on an enlarged scale, of a portion of the security sensor according to a second preferred embodiment of the present invention.

FIG. 5 illustrates a fragmentary sectional view, on an enlarged scale, of a portion of the security sensor according to a second preferred embodiment of the present invention. In this figure, component parts that are similar to those employed in FIG. 3 are designated by like reference numerals.

The security sensor according to the embodiment shown in FIG. 5 is featured in that each of the light exit surface 8*c* of the projector-side light guide member 8 and the light incident surface 9*a* of the receiver-side light guide member 9 is, in the form of a flat smooth surface whereas the light reflecting surface 9*b* of the receiver-side light guide member 9 is ground, that is, formed with fine surface irregularities generally similar to those found on a ground glass.

According to the second preferred embodiment, the amount of the disturbance detecting beam L1 emerging outwardly from the light exit surface 8*c* of the projector-side light guide member 8 and subsequently entering the receiver-side light guide member 9 is larger than that in the previously described first embodiment. However, since the disturbance detecting beam L1 entering the receiver-side light guide member 9 is diffused as it is reflected by the light reflecting surface 9*b* of the receiver-side light guide member 9, the amount of the disturbance detecting beam L1 received by the light receiving element 12 decreases down to a value about equal to that in the previously described first embodiment. In the event that the transparent paint is applied and deposits on the light reflecting surface 9*b* of the receiver-side light guide member 9, the surface irregularities of the light reflecting surface 9*b* are filled up by the transparent paint to represent a flat smooth surface and, as a result thereof, the amount of the light reflected by the light reflecting surface 9*b* increases, resulting in increase of the amount of the light received by the light receiving element 12. Also, in the event of the black-colored paint applied, the amount of the light received by the light receiving element 12 decreases as is the case with that described in connection with the first embodiment and, therefore, the presence of the obstacle can be detected in the manner described hereinbefore.

Figure 6:
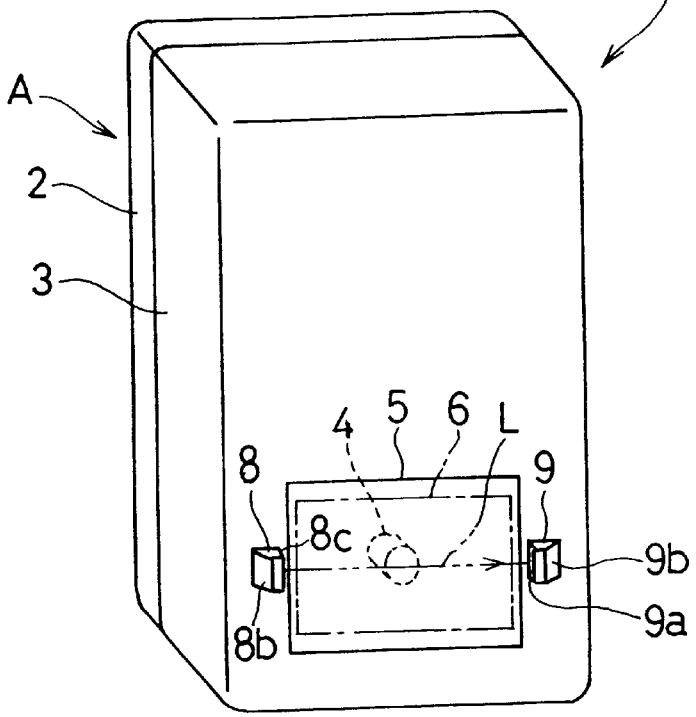
FIG. 6 is a perspective view of the security sensor having a disturbance detecting capability according to a third preferred embodiment of the present invention.

FIG. 6 illustrates a perspective view of the security sensor according to a third preferred embodiment of the present invention, wherein component parts that are similar to those shown in FIG. 1 are designated by like reference numerals. The security sensor according to this third embodiment is of a structure wherein the projector-side light guide member 8 and the receiver-side light guide member 9 are mounted on the cap-like casing 3 at respective locations adjacent opposite sides of the lens 5, i.e., left and right sides of the lens 5 as viewed therein. The lens 5 employed in the practice of the third embodiment is in the form of a generally rectangular flat lens. The optical path L for the travel of the disturbance detecting beam L1 is defined along the outer surface of the lens 5 so as to extend between the projector-side and receiver-side light guide members 8 and 9. One or more surfaces of the light reflecting surface 8*b* and light exit surface 8*c* of the projector-side light guide member 8 and the light incident surface 8*a* and light reflecting surface 9*b* of the receiver-side light guide member 9 is ground to provide surface irregularities similar to those found in a ground glass. The security sensor 1 according the third embodiment can function in a manner similar to that according to any one of the first and second embodiments to similarly perform the disturbance detecting capability.

Figure 7:
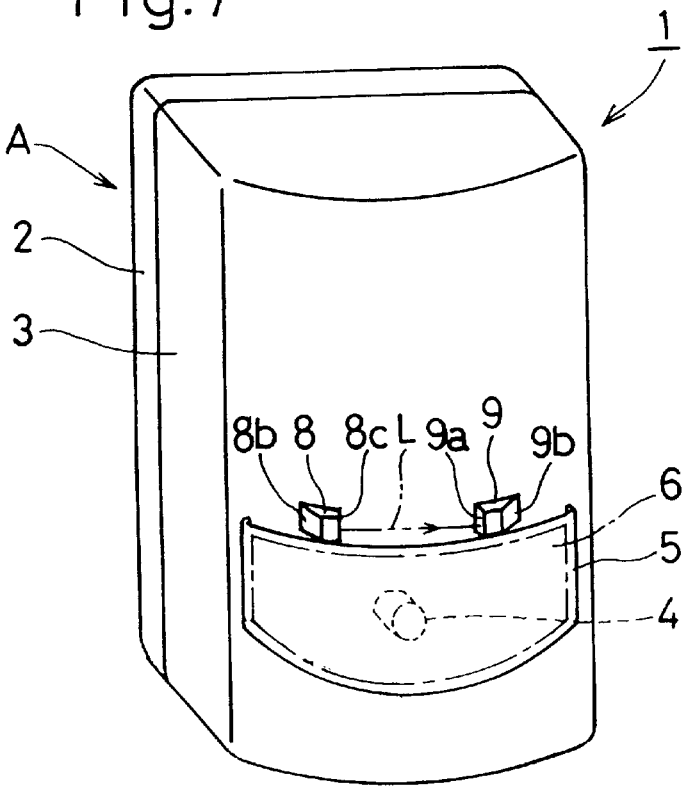
FIG. 7 is a perspective view of the security sensor having a disturbance detecting capability according to a fourth preferred embodiment of the present invention.

FIG. 7 illustrates a perspective view of the security sensor according to a fourth preferred embodiment of the present invention, wherein component parts that are similar to those shown in FIG. 1 are designated by like reference numerals. The security sensor according to this fourth embodiment is of a structure wherein the projector-side light guide member 8 and the receiver-side light guide member 9 are mounted on the cap-like casing 3 at respective locations adjacent one side of the lens 5, for example, an upper side of the lens 5 as viewed therein. The lens 5 employed in the practice of the fourth embodiment is in the form of a convex plate having a relatively small radius of curvature. The optical path L for the travel of the disturbance detecting beam L1 is defined along the outer surface of the lens 5 so as to extend between the projector-side and receiver-side light guide members 8 and 9. The light exit surface 8*c* of the projector-side light guide member 8 and the light incident surface 9*a* of the receiver-side light guide member 9 are spaced a small distance from each other so as to confront each other so that the optical path L for the disturbance detecting beam L1 that extends between the light exit surface 8*c* and the light incident surface 9*a* will not be obstructed by a convex surface of the lens 5.

Even in this fourth embodiment of the present invention, as one or more surfaces of the light reflecting surface 8*b* and light exit surface 8*c* of the projector-side light guide member 8 and the light incident surface 8a and light reflecting surface 9*b* of the receiver-side light guide member 9 is ground to provide surface irregularities similar to those found in a ground glass, the security sensor 1 according to the fourth embodiment can function in a manner similar to that according to any one of the first to third embodiments to similarly perform the disturbance detecting capability.

Figure 8:
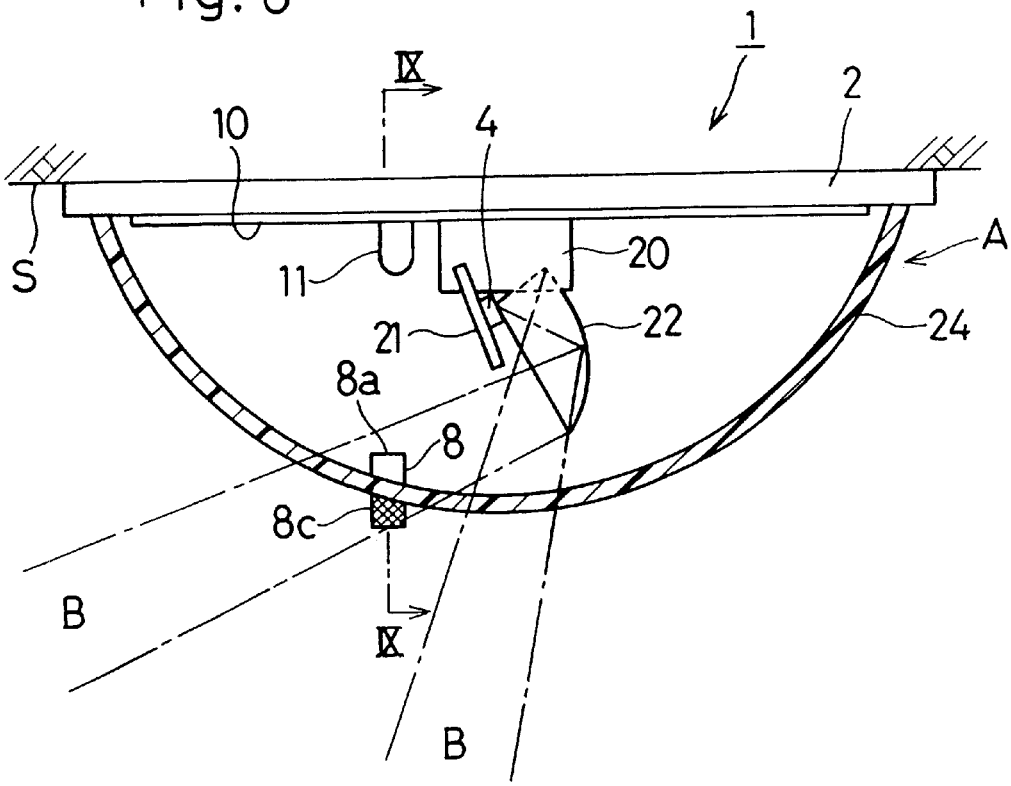
FIG. 8 is a sectional view of the security sensor having a disturbance detecting capability according to a fifth preferred embodiment of the present invention.
Figure 9:
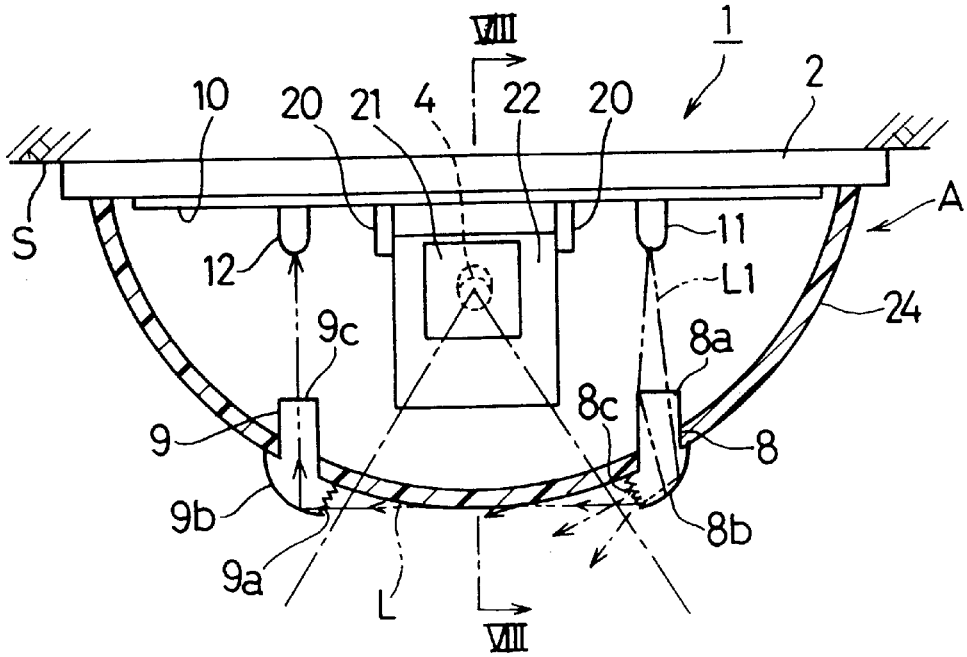
FIG. 9 is a cross-sectional view taken along the line IX—IX in FIG. 8.

FIGS. 8 and 9 illustrate the security sensor according a fifth embodiment of the present invention, wherein FIG. 8 represents the cross-sectional view taken along the line VIII—VIII in FIG. 9 and FIG. 9 represents the cross-sectional view taken along the line IX—IX in FIG. 8. Component parts which are shown in FIGS. 8 and 9, but are similar to those shown in FIGS. 1 to 3 are identified by like reference numerals used in FIGS. 1 to 3.

The security sensor 1 similarly includes a box-like carrier body A made up of a generally rectangular base 2 adapted to be fitted to a support surface such as, for example, a ceiling S. A printed circuit board 10 is fitted to the base 2 and includes a pair of support members 20 and 20 mounted thereon. A carrier substrate 21 is adjustably supported by the support members 20 and 20 for rotation about an axis connecting between the support members 20 and 20 and has a pyroelectric element 4 and a polygon mirror 22 mounted on the carrier substrate 21 so as to define a plurality of detection areas B. A semispherical cover (incident side enclosure) 24 made of an opaque synthetic resin is capped onto the base 2 so as to enclose incident surface areas of the pyroelectric element 4 and polygon mirror 22. As shown in FIG. 9, projector-side and receiver-side light guide members 8 and 9 are mounted on the semispherical cover 24 and are positioned outside a portion of the cover 24 where the detection areas B extend, that is, outside an light incident area through which the near infrared light is incident on the pyroelectric element 4, so that the light exit surface 8*c* of the projector-side light guide member 8 can assume a face-to-face relation with the light incident surface 9*a* of the receiver-side light guide member 9 with an optical L defined therebetween for the disturbance detecting light L1. The semispherical cover 24 employed in the embodiment shown in FIGS. 8 and 9 serves merely to protect the sensor carrier body A and has no lens capability that defines the detection areas. The light projecting and receiving elements 11 and 12 are fixedly mounted on the printed circuit board 10. Thus, the pyroelectric element 4 and the light projecting and receiving elements 11 and 12 are supported by the base 2 forming a part of the sensor carrier body A and are encased by the semispherical cover 24 fitted to the base 2. The light projecting element 11 is electrically connected with the drive circuit 13 shown in FIG. 3 whereas the light receiving element 12 is electrically connected with the incident light amount detecting circuit 14 and the detecting circuit 15 both also shown in FIG. 3.

In the security sensor 1 according to the embodiment shown in FIGS. 8 and 9, the light exit surface 8*c* of the projector-side light guide member 8 that is ground to have the surface irregularities and the light incident surface 9*a* of the receiver-side light guide member 9 that is also ground to have the surface irregularities cooperate to define the optical path L extending therebetween for the disturbance detecting beam L1. This optical path L extends straight between the light exit surface 8*c* of the projector-side light guide member 8 and the light incident surface 9*a* of the receiver-side light guide member 9 over the curved outer surface of the cover 24 with the light guide members 8 and 9 protruding outwardly from the cover 24.

Accordingly, as is the case with the previously described first embodiment of the present invention, in the event that the obstacle, such as the transparent paint or the black-colored paint, deposits on one or both of the light exit surface 8*c* and the light incident surface 9*a,* the amount of the light received by the light receiving element 12 increases to a value higher or decreases a value lower than that exhibited when no obstacle is applied and, therefore, the presence of the obstacle can be detected by the detecting circuit 15.

The obstacle with which the security sensor embodying the present invention can work may include, other than the transparent paint referred to in the foregoing description, an adhesive tape of transparent plastics or cellophane, a gel or creamy adhesive material or a sealant. Where the obstacle of this kind is applied to the outer surface of the lens 5, the surface irregularities of the light reflecting surface 8*b* or light exit surface 8*c* of the projector-side light guide member 8, or the light incident surface 9*a* or light reflecting surface 9*b* of the receiver-side light guide member 9 are filled up by the obstacle due to its own viscosity and, therefore, the amount of the light received by the light receiving element 12 varies so that the presence of the obstacle can be detected by the detecting circuit 15 then detecting such a change in amount of the light received by the light receiving element 12. Even where the obstacle is a liquid medium such as, for example, water or oil, deposit of such an obstacle renders the surface irregularities of the light reflecting surface, the light exit surface or the light incident surface to represent a substantially flat surface before it dries up and, therefore, the amount of the light received by the light receiving element 12 varies so that the presence of the obstacle can be detected by the detecting circuit 15.

It is to be noted that in any one of the foregoing embodiments the surface where the surface irregularities are formed may be a part of or the entirety of at least one of the surfaces exposed to the outside, or the light reflecting surface 8*b,* the light exit surface 8*c* (both of the projector-side light guide member 8), the light incident surface 9*a* and the light reflecting surface 9*b* (both of the receiver-side light guide member 9). It is also to be noted that the projector-side light guide member 8 or the receiver-side light guide member 9 may have a portion thereof positioned within the area of incidence of the near infrared light on the pyroelectric element 4.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A security sensor having a disturbance detecting capability, which comprises:

a carrier body having an infrared sensor element;

an incident side enclosure mounted on the carrier body, said incident side enclosure comprising a lens that defines at least one detection area for the infrared sensor element or a cover that covers an incident surface area of the infrared sensor element;

a light projecting element for projecting a disturbance detecting beam;

a light receiving element for receiving at least a portion of the disturbance detecting beam;

first and second light guide members separate from each other with a space therebetween and operatively associated with the light projecting element and the light receiving element, respectively, said first and second light guide members being cooperative with each other to define an optical path along and adjacent an outer surface of the incident side enclosure or an outer surface of the carrier body adjacent the incident side enclosure so as to extend between the first and second light guide members;

a detecting circuit for detecting a presence or absence of an obstacle, applied to at least one of the first and second light guide members, based on an amount of light received by the light receiving element; and surface irregularities formed on a light transmitting surface or a light reflecting surface of the first or second light guide members which surface is exposed traverse to the optical path.

2. The security sensor as claimed in claim 1, wherein the first light guide member has a first light incident surface, a first light exit surface and a first light reflecting surface defined therein and is operable to guide the beam from the first light incident surface towards the first light exit surface through the first light reflecting surface, and the second light guide member has a second light incident surface, a second light exit surface and a second light reflecting surface defined therein and is operable to guide the beam from the second light incident surface towards the second light exit surface through the second light reflecting surface, and wherein the surface irregularities are formed on at least one of the first light exit surface, the first light reflecting surface, the second light incident surface and the second light reflecting surface.

3. The security sensor as claimed in claim 2, wherein the first and second light guide members are mounted on the carrier body at respective locations outside an area of incidence of infrared light on the infrared sensor elements.

4. The security sensor as claimed in claim 2, the carrier body comprises a support base for supporting the infrared sensor element, the light projecting element and the light receiving element, and a cover which defines the incident side enclosure and fitted to the support base so as to enclose the infrared sensor element, the light projecting element, and the light receiving element, and wherein the first and second light guide members are positioned on the cover at respective locations spaced a distance from each other.

5. The security sensor as claimed in claim 1, wherein the first and second light guide members are mounted on the carrier body at respective locations outside an area of incidence of infrared light on the infrared sensor element.

6. The security sensor as claimed in claim 5, the carrier body comprises a support base for supporting the infrared sensor element, the light projecting element and the light receiving element, and a cover which defines the incident side enclosure and fitted to the support base so as to enclose the infrared sensor element, the light projecting element, and the light receiving element, and wherein the first and second light guide members are positioned on the cover at respective locations spaced a distance from each other.

7. The security sensor as claimed in claim 1, wherein the infrared sensor element, the light projecting element and the light receiving element are mounted on a common circuit board.

8. The security sensor as claimed in claim 1, wherein the carrier body comprises a support base for supporting the infrared sensor element, the light projecting element and the light receiving element, a casing and a lens which defines the incident side enclosure and fitted to the casing with the infrared sensor element, the light projecting element and the light receiving element being covered by the casing and the lens, and wherein the first and second light guide members are positioned on the casing at respective locations adjacent the lens.

9. The security sensor as claimed in claim 1, the carrier body comprises a support base for supporting the infrared sensor element, the light projecting element and the light receiving element, and a cover which defines the incident side enclosure and fitted to the support base so as to enclose the infrared sensor element, the light projecting element and the light receiving element, and wherein the first and second light guide members are positioned on the cover at respective locations spaced a distance from each other.

10. A security sensor system comprising:

a detector element for detecting infrared radiation representative of an intruder in a target area;

a cover member extending over the detector element and having an incident surface transmissive of the infrared radiation from the target area;

a source of a disturbance detecting beam directed above the cover member and on the other side of the cover member from the detector element; and a disturbance detecting beam detector unit having a light guide member with an incident surface positioned above the cover member to receive a portion of the disturbance detecting beam that will vary depending upon a presence of any obstacle placed over the incident surface of the light guide member whereby the variance in reception of the amount of the disturbance detecting beam will be an indication of an obstacle, wherein the source of the disturbance detecting beam and the incident surface of the light guide member are spaced apart and above the cover member to provide an air gap there between.

11. The security sensor as claimed in claim 10 wherein the incident surface of the light guide member is traverse to the surface of the cover member.

12. The security sensor as claimed in claim 11 wherein the incident surface of the light guide member has surface irregularities wherein an obstacle that varies the transmissive capability of the disturbance detecting beam will be detected.

13. The security system as claimed in claim 11 wherein a surface of the light guide member, exterior of the cover member, has surface irregularities wherein any obstacle that varies the transmission capability of the disturbance detecting beam will be detected.

14. The security system as claimed in claim 10 wherein the source of the disturbance detecting beam has a transmission surface traverse to the surface of the cover member, the incident surface of the light guide member and the transmission surface have surface irregularities wherein any obstacle that varies the transmission capability of the disturbance detecting beam will be detected.

15. The security system as claimed in claim 14 wherein the cover member has a smooth exterior surface and a Fresnel lens interior surface.

16. A security sensor system comprising:

a detector element for detecting infrared radiation representative of an intruder in a target area;

a cover member extending over the detector element and having an incident surface transmissive of the infrared radiation from the target area;

a source of a disturbance detecting beam having a transmission surface extending above the cover member and directing the disturbance detecting beam across the incident surface of the cover member; and a disturbance detecting beam detector unit having an incident light guide surface extending above the cover member and spaced from the transmission surface to provide an air gap there between, the incident light guide surface will receive a portion of the disturbance detecting beam that will vary depending upon a presence of any obstacle placed over at least one of the transmission surface and the incident light guide surface, at least one of the transmission surface and the incident light guide surface will have surface irregularities whereby any obstacle that varies the transmission capability of the disturbance detecting beam will be detected.

17. The security system as claimed in claim 16 wherein the transmission surface and the incident light guide surface extend traverse to the cover member incident surface.

18. The security system as claimed in claim 17 wherein the cover member incident surface is smooth.

19. The security system as claimed in claim 18 wherein the transmission surface and the incident light guide surface are mounted respectively adjacent opposite sides of the cover member.

* * * * *